US008475291B2

(12) United States Patent
Noble et al.

(10) Patent No.: US 8,475,291 B2
(45) Date of Patent: Jul. 2, 2013

(54) MULTIPLE FLEX SHAFT METHOD AND SYSTEM FOR GOLF CLUBS

(75) Inventors: Randall B. Noble, Phoenix, AZ (US); Marty R. Jertson, Cave Creek, AZ (US); Jeff A. Blankenship, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/591,910

(22) Filed: Aug. 22, 2012

(65) Prior Publication Data

US 2012/0322572 A1 Dec. 20, 2012

Related U.S. Application Data

(63) Continuation of application No. 13/172,629, filed on Jun. 29, 2011, now Pat. No. 8,282,503, which is a continuation of application No. 12/193,625, filed on Aug. 18, 2008, now abandoned, which is a continuation-in-part of application No. 11/876,508, filed on Oct. 22, 2007, now abandoned, which is a continuation of application No. 10/721,854, filed on Nov. 24, 2003, now Pat. No. 7,300,358.

(51) Int. Cl.
*A63B 53/10* (2006.01)
*A63B 53/12* (2006.01)

(52) U.S. Cl.
USPC ..... 473/287; 473/409

(58) Field of Classification Search
USPC ..... 473/287, 289, 290–291, 409
See application file for complete search history.

(56) References Cited

U.S. PATENT DOCUMENTS

| | | | |
|---|---|---|---|
| 3,871,649 | A | 3/1975 | Kilshaw |
| 3,963,236 | A | 6/1976 | Mann |
| 4,070,022 | A | 1/1978 | Braly |
| 4,240,631 | A | 12/1980 | MacDougall |
| 4,319,750 | A | 3/1982 | Roy |
| 4,563,007 | A | 1/1986 | Bayliss et al. |
| 4,685,682 | A | 8/1987 | Isabell |
| 5,093,162 | A | 3/1992 | Fenton et al. |
| 5,192,073 | A | 3/1993 | Iwanaga et al. |
| 5,351,951 | A | 10/1994 | Hodgetts |
| 5,380,005 | A | 1/1995 | Hsu |
| 5,505,446 | A | 4/1996 | Whitaker |
| 5,591,091 | A | 1/1997 | Hackman |
| 5,616,832 | A | 4/1997 | Nauck |
| 5,722,899 | A | 3/1998 | Cheng |
| 5,821,417 | A | 10/1998 | Naruo et al. |
| 5,879,241 | A | 3/1999 | Cook et al. |
| 5,924,936 | A | 7/1999 | Penley |
| 5,944,616 | A | 8/1999 | Horwood et al. |
| 6,558,278 | B2 | 5/2003 | Bunn et al. |
| 6,729,970 | B2 | 5/2004 | Horwood et al. |
| 7,300,358 | B2 | 11/2007 | Noble |
| 2001/0006911 | A1 | 7/2001 | Bunn et al. |
| 2005/0113183 | A1 | 5/2005 | Noble |

FOREIGN PATENT DOCUMENTS

| | | | |
|---|---|---|---|
| GB | 2227418 | A | 8/1990 |

*Primary Examiner* — Stephen L. Blau

(57) ABSTRACT

Embodiments of multiple flex shaft systems are disclosed herein. Other examples and related methods are also presented herein.

8 Claims, 7 Drawing Sheets

A: SHAFTS OPTIMIZED FOR SLOW SWING SPEED
B: SHAFTS OPTIMIZED FOR AVERAGE-SLOW SWING SPEED
C: SHAFTS OPTIMIZED FOR AVERAGE SWING SPEED
D: SHAFTS OPTIMIZED FOR AVERAGE-HIGH SWING SPEED
E: SHAFTS OPTIMIZED FOR HIGH SWING SPEED

1000

1100

MULTIPLE FLEX SHAFT METHOD AND SYSTEM FOR GOLF CLUBS

CROSS REFERENCE TO RELATED APPLICATIONS

This application is a continuation of U.S. patent application Ser. No. 13/172,629, filed Jun. 29, 2011, which is a continuation of U.S. patent application Ser. No. 12/193,625, filed Aug. 18, 2008, now abandoned, which is a continuation-in-part of U.S. patent application Ser. No. 11/876,508, filed Oct. 22, 2007, now abandoned, which is a continuation of U.S. patent application Ser. No. 10/721,854, filed Nov. 24, 2003, now U.S. Pat. No. 7,300,358. The disclosures of the referenced applications are incorporated herein by reference.

TECHNICAL FIELD

This disclosure relates to golf clubs. More specifically, the disclosure relates to methods of optimizing the flexibility of a plurality of golf club shafts that comprise a set of golf clubs.

BACKGROUND

It is well-known that golf clubs can be designed to suit the needs of a plurality of golfers, which span a broad range of skill levels. For example, golf club manufacturers have designed golf club heads for less skilled or practiced players to include, in some instances, a larger club face. Golf clubs that employ a relatively larger hitting area are often intended to minimize the unwanted effects of "miss-hits," which are more prevalent among less practiced or skilled players. In addition, golf clubs designed for less practiced or skilled players often employ an "offset" club head—especially for the low to mid-irons. An "offset" club head provides more time during a swing to square the club head to the ball just before impact, which increases the possibility of a straight ball flight.

Optimizing golf clubs to accommodate the needs of various skill levels has not been restricted to club head design. Indeed, golf club designers and manufacturers have devoted a considerable amount of time, money and effort to optimizing golf club shafts as well. In particular, shafts have been designed in ways to address certain characteristics that are prevalent among golfers of high, medium and low skill levels.

Specifically, it has been found that less practiced or skilled players often exhibit a relatively slower swing speed when compared to more skilled players. It is also well-known that golfers having relatively slower swing speeds may benefit from a more flexible shaft, whereas golfers having relatively higher swing speeds, typically, may benefit from using more rigid shafts. Shaft flex is a measurement of the amount to which a shaft will bend under a certain load. When a player swings a golf club, the mass of the club head and the velocity of the swing cause the shaft to flex. Shaft flex can play an important role in the trajectory and distance that a ball travels, as well as the "feel" that a golfer experiences when swinging a club and striking a ball.

In addition, shaft flex can influence the amount of control that a golfer may have over the relative direction that a golf ball travels. Specifically, more rigid golf club shafts have been found to provide golfers with relatively higher swing speeds with a greater level of control over their golf shots. More flexible golf club shafts, however, may enable less practiced or skilled players, or players with relatively slower swing speeds, to increase the velocity of the golf club head at ball impact. An increase in club head velocity, of course, may enable such golfers to hit the ball a greater distance. In light of the foregoing, golf club designers and manufacturers have, generally, designed and offered golf clubs having shafts with greater flexibility for golfers with slower swing speeds and shafts with lesser flexibility for golfers having higher swing speeds and greater skill levels.

Another golf club design factor is the loft of the club head. The loft of a club is typically defined as the angle between the face of the golf club and the center line of the hosel. A set of golf clubs typically includes one or more "woods," a set of irons, and wedges. The woods may include, for example, a driver (1-wood), 2-wood, 3-wood, 4-wood, 5-wood, 6-wood, 7-wood, or any combination thereof. Additionally, golf club manufacturers offer woods based upon the loft of the club, and do not always identify woods by numbers (e.g., 3-wood, 5-wood). Golf club irons often include 3 through 9 irons, and sometimes 1 and 2 irons. Wedges often include a pitching wedge, sand wedge, gap wedge and/or a lob wedge, and in recent years a variety of specialty wedges and hybrid-type golf club heads have been offered in the marketplace.

The loft of each wood, and the loft of each iron, hybrid, and wedge, typically, differ from one another in a set. For example, a driver always has a lower degree-loft than a 3-wood in a set of clubs, and a 3-wood will always have a lower degree-loft than a 5-wood in a set of clubs. Likewise, a 3-iron will always have a lower degree-loft than a 4-iron in a set of clubs, and a 4-iron will always have a lower degree-loft than a 5-iron in a set of clubs. The degree-loft affects the effective trajectory that can be imparted on a golf ball by the club. In general, the higher the loft of a club head, the higher the effective trajectory of the ball that has been struck by the club.

The different woods, hybrids, irons, and wedges that comprise a set of clubs are designed to address a plurality of golf shots that may be needed or desired. Drivers, for example, are typically used to hit a golf ball as far as possible. Similarly, wedges are often used to hit a ball a short distance. For purposes of illustration only, the greater the degree of loft of a club, the lesser distance the ball will typically travel.

Until now, golf club designers have, typically, categorized shaft designs into two general categories: (i) shafts designed for drivers and/or woods; and (ii) shafts designed for irons and wedges. For years, golf club manufacturers have designed and specified shafts for drivers and woods to be, generally, more flexible when compared to iron and wedge shafts for the same set of clubs. As stated, the more flexible shafts may allow golfers to hit the ball further than would be possible with more rigid shafts, which is typically the purpose behind hitting a driver or wood.

When golf club shafts were fitted for a particular golfer, regardless of the golfer's swing speed, one type of shaft (having a particular flexibility) was selected for the driver and woods, while a second type of shaft (having, most often, a lesser flexibility) was chosen for irons and wedges. This is consistent with the desire to employ greater shaft-flex in drivers and woods to hit the ball further. The additional variable of adding increased shaft-flex can also affect the accuracy of a golf club, depending of course upon the skill of the particular golfer.

DETAILED DESCRIPTION

Figure 1:
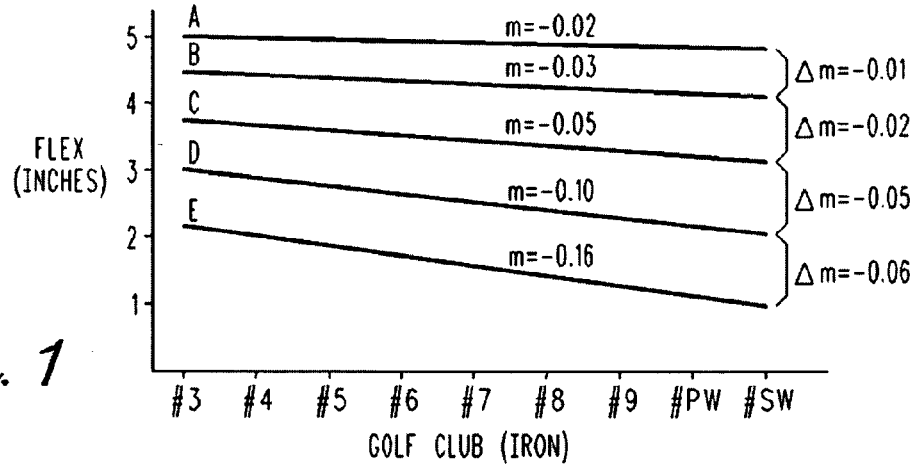
FIG. 1: Chart summarizing one of the preferred embodiments of the multiple flex shaft system and method for golf clubs, wherein the range of flexibility exhibited by a plurality of shafts that comprise each of a plurality of categories of shafts vary, wherein the amount of such variability in range of flexibility among the several categories is irregular.

The following will describe in detail several preferred embodiments of the multiple flex shaft system and method for golf clubs. These embodiments are provided by way of explanation only, and thus, should not unduly restrict the scope of the system or method. In fact, those of ordinary skill in the art will appreciate upon reading the present specification and viewing the present drawings that the system and method teaches many variations and modifications, and that numerous variations of the system or method may be employed, used and made without departing from the scope and spirit of the system or method.

The system and method described herein does not simply divide shaft flexibility into two general categories, i.e., one flexibility for drivers and woods, and a second for irons and wedges. Instead, the system and method teaches an entirely new and unique approach that each shaft used in a set of clubs may be optimized for each specific club by custom fitting the individual golfer for each club—depending upon the swing speed, skill level of the golfer, desired distance, and desired accuracy. Thus, each individual shaft in a set of golf clubs may be individually custom fit, and further, the shafts will often represent a continuum of flexibilities. Still further, the present system and method teaches that the nature of this continuum of flexibilities will, preferably, be different among golfers of low, medium and high skill levels and/or having slow, medium or high swing speeds.

The system and method relate to methods for optimizing the flexibility of each shaft that is used in a set of golf clubs. In a first preferred embodiment, the approximate swing speed of the golfer for a particular golf club or set of clubs will be determined. There are several methods well-known in the art that can be used to measure the approximate swing speed of a golfer. Based on the golfer's estimated swing speed for a particular club or set of clubs, an appropriate category of golf club shafts is selected from two or more categories.

Each of the two or more categories of golf club shafts, preferably, employ a unique range of shaft flexibility. The range of flexibility exhibited by categories of golf club shafts optimized for golfers with high swing speeds will, generally, be greater than the range of flexibility exhibited by categories of golf club shafts optimized for golfers with relatively slower swing speeds. The system and method may employ an unlimited number of categories of shafts, wherein each category of shafts is considered to be optimized for a specific range of swing speeds. That is, one embodiment of the system and method provides for two categories of shafts to be considered when optimizing shaft flexibility for a set of shafts, wherein one category is, for example, appropriate for golfers with "high swing speeds" and the other optimized for golfers with "medium and low swing speeds." Alternatively, by way of example only, another embodiment of the system and/or method provides that as many as fifty (50) categories of shafts may be considered when optimizing shaft flexibility for a set of shafts, wherein one category is appropriate for golfers having swing speeds of 70 miles per hour (m.p.h.) or below, another category for golfers having swing speeds between 70-71 m.p.h., another for 71-72 m.p.h., and so on; up to swing speeds of 120 m.p.h. or above. In sum, the system and method is not limited to any number of categories of shafts for a set of clubs; rather, any number of categories of shafts can be used. The range of flexibility exhibited by the sets of shafts that comprise each category may increase in relation to the swing speeds for which each category is optimized, wherein the range of flexibility accorded to each category increases as the corresponding swing speeds for which such categories of shafts are optimized increase.

Figure 2:
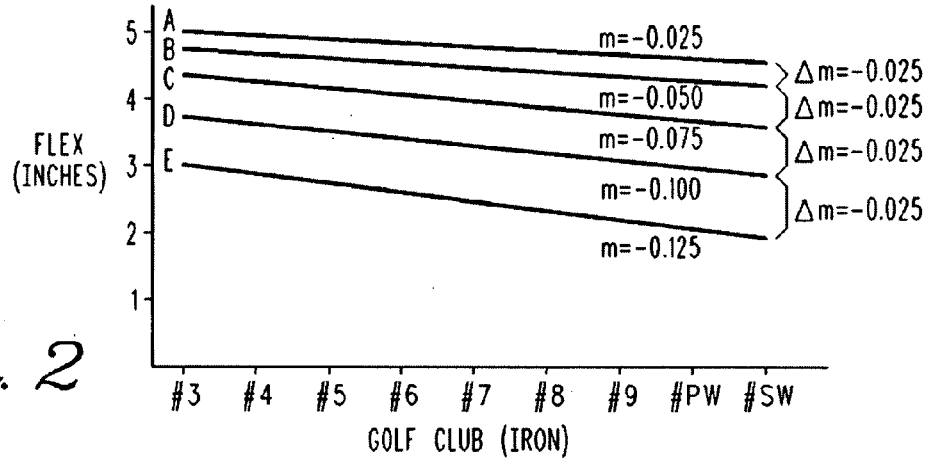
FIG. 2: Chart summarizing one of the preferred embodiments of the system and method, wherein the range of flexibility exhibited by a plurality of shafts that comprise each of a plurality of categories of shafts vary, wherein the amount of such variability in range of flexibility among the several categories is consistent.

The difference in the range of flexibility exhibited by the sets of shafts that comprise each category, in one preferred embodiment, may be consistent or irregular. To illustrate this point, FIGS. 1 and 2 show a plurality of sets of golf club shafts that are, preferably, optimized for at least five (5) different swing speeds. In each example, the variance in flexibility among the shafts that comprise each category is consistent, i.e., the variance in flexibility among the several shafts that comprise each category is linear. Thus, the range of flexibility exhibited by the several sets of shafts, which consist of the same amount and type of clubs, that comprise each category can be estimated in FIGS. 1 and 2, for example, by calculating the approximate slope ("m") of each line shown therein. Of course, the absolute value of the slope ("m") values accorded to each category can be compared to ascertain the relative difference in range of shaft flexibility exhibited by the several categories. Alternatively, those skilled in the art will appreciate that the range of flexibility exhibited by the several shafts that comprise each category can be estimated by simply calculating the difference in flex between the clubs of a set having the lowest and highest loft.

In FIG. 1, the range of flexibility exhibited by each set of shafts that comprise the five different categories varies. That is, the range of flexibility exhibited by each category of shafts, which is represented by the slope ("m") value, is not the same. As shown in FIG. 1, the estimated range of flexibility for category A is represented by a slope of m=−0.02; whereas, for example, the estimated range of flexibility for category D is represented by a slope of m=−0.10. Thus, the several categories of golf club shafts shown in FIG. 1 do not exhibit the same range of flexibility within each category.

As stated, the difference in the range of flexibility exhibited by the sets of shafts that comprise each category, in one preferred embodiment, may be consistent or irregular. In FIG. 1, for example, the difference in the range of flexibility between category A and B is shown to be approximately "Δm=−0.01," whereas the difference in range of flexibility between category C and D is estimated to be "Δm=−0.05." Thus, in FIG. 1, the difference in the range of flexibility exhibited by each category of shafts is irregular. It should be appreciated by those skilled in the art that the difference in the range of flexibility exhibited by the several categories of shafts could, alternatively, be consistent. FIG. 2 provides a non-limiting example of such an embodiment, wherein the range of flexibility exhibited by each set of shafts that comprise the five different categories varies as represented by the different slope ("m") values, wherein this variability is consistent among the five categories of shafts as represented by the same Δm values.

Still further, the variance in flexibility among the shafts that comprise any given category of shafts may be consistent or irregular. For example, the amount of difference in shaft flexibility between the 3-iron and 4-iron, the 4-iron and 5-iron, and so on may be substantially the same, or, alternatively, the amount of difference in shaft flexibility between the various shafts that form a set or irons, for example, may be different. The variance in flexibility among the shafts that comprise each of the categories of shafts shown in FIGS. 1 and 2, for example, is consistent. Thus, as described earlier, the range in flexibility among the plurality of shafts that comprise each category of shafts can be linearly represented.

Figure 3:
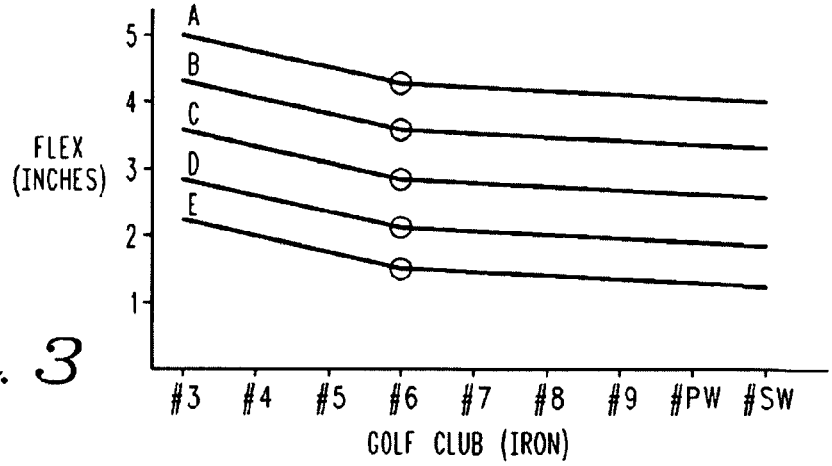
FIG. 3: Chart summarizing one of the preferred embodiments of the system and method, wherein the variance in shaft flexibility among the several shafts that comprise each category is irregular.

The system and method further provide that the variance in shaft flexibility among the several shafts that comprise each category may be irregular. For example, the difference in shaft flexibilities, if any, among the "short-irons" may be more subtle than the difference in shaft flexibilities among the "long-irons." By way of example only, FIG. 3 illustrates five categories of shafts that exhibit such characteristics. In this embodiment, the variance in flexibility among the several respective shafts that comprise each category may be consistent or irregular. For example, the amount of difference in shaft flexibility among the 3-, 4-, 5- and 6-irons shown in FIG. 3 is substantially the same for categories A through E.

Figure 4:
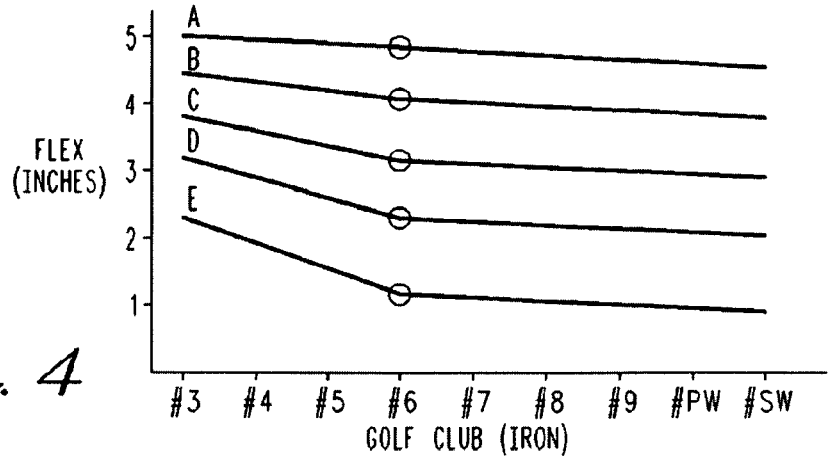
FIG. 4: Chart summarizing one of the preferred embodiments of the system and method, wherein the variance in shaft flexibility among the several shafts that comprise each category is irregular, wherein the variance in shaft flexibility between respective golf clubs of two or more categories also varies.

Alternatively, however, the difference in shaft flexibility among respective clubs of two or more categories may be irregular. As shown in FIG. 4, for example, the difference in shaft flexibility among the 3-, 4-, 5- and 6-irons for category A is significantly less than the difference among the same irons for category E. Consistent with other preferred embodiments described herein, the range of flexibility exhibited by the sets of shafts that comprise each category will, preferably, increase in relation to the swing speeds for which each category is optimized, wherein the range of flexibility accorded to each category increases as the corresponding swing speeds for which such categories of shafts are optimized increase.

Figure 5:
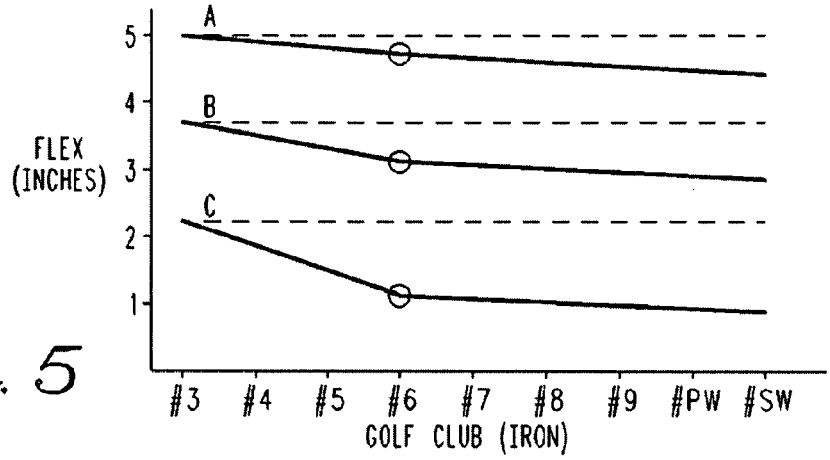
FIG. 5: Chart illustrating a method by which the estimated range of flexibility exhibited by a plurality of shafts that comprise a category of shafts can be calculated.

When the variance in shaft flexibility among the several shafts that comprise each category is irregular, the range of flexibility for each category can be estimated by simply calculating the difference in flex between the clubs having the lowest and highest loft, e.g., between the 3-iron and wedge, the 1-iron and wedge, the driver (1-wood) and wedge, etc. FIG. 5 illustrates this non-limiting example of how one skilled in the art may estimate the range of flexibility exhibited by several shafts that comprise a category of shafts.

Figure 6:
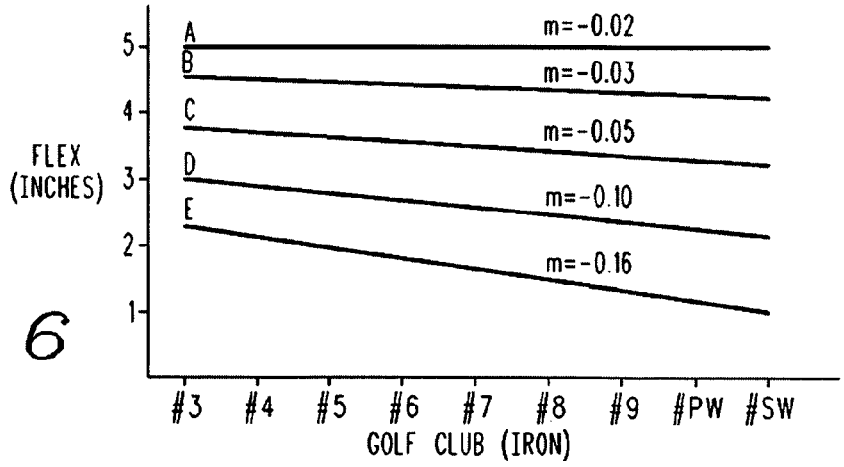
FIG. 6: Chart summarizing one of the preferred embodiments of the system and method, which illustrates five categories of shafts that are, preferably, optimized for golfers with different swing speeds.

FIG. 6 provides a non-limiting example of another embodiment of the system and method in which five categories of shafts may be optimized for golfers who are capable of the various swing speeds shown therein. Consistent with the foregoing, the range of flexibility exhibited by the set of shafts shown in FIG. 6 to be optimized for golfers with high swing speeds, identified as "E," is greater than the range of flexibility exhibited by the category of shafts shown to be optimized for average swing speeds, identified as "C." Likewise, the range of flexibility exhibited by the category of shafts shown in FIG. 6 to be optimized for golfers with average swing speeds is greater than the range of flexibility exhibited by the category of shafts shown to be optimized for slow swing speeds, identified as "A." Still further, FIG. 6 shows two intermediate levels of swing speeds, labeled "average-slow" and "average-high" swing speeds, or "B" and "D," respectively.

The various categories of swing speeds presented in FIG. 6 are identified as such for purposes of illustration only. Of course, those skilled in the art may simply categorize various swing speeds numerically. For example, swing speeds of 110 miles per hour ("m.p.h.") or higher may be considered "high," swing speeds ranging from 100-110 m.p.h. may be considered "average-high," swing speeds ranging from 90-100 m.p.h. may be considered "average," swing speeds ranging from 80-90 m.p.h. may be considered "average-slow," and swing speeds below 80 m.p.h. may be considered "slow."

In another preferred embodiment, the system and method provide methods of optimizing sets of shafts, wherein the relative skill level of each golfer for which any given set of golf club shafts will be optimized is considered. There are several methods well-known in the art to measure the approximate skill level of a golfer. A non-limiting example may involve the handicap system developed and managed by the United States Golf Association ("USGA"). For example, golfers with handicaps at or below 6 may be considered "highly skilled," golfers with handicaps between 6 and 13 may be considered "average to highly skilled," golfers with handicaps between 13 and 28 may be considered "average to below-average," and golfers with handicaps greater than 28 may be considered "below-average." Furthermore, in custom fitting a golfer, the individual golfer may be evaluated for their specific skill and performance level—whether overall, or club by club.

Based on the golfer's estimated skill level, in one preferred embodiment, an appropriate category of golf club shafts may be selected from two or more categories. Each category of golf club shafts employ a unique range of shaft flexibility, as described above. The range of flexibility exhibited by categories of golf club shafts optimized for golfers of high skill levels, generally, is greater than the range of flexibility exhibited by categories of golf club shafts optimized for golfers of relatively lower skill levels.

Figure 7:
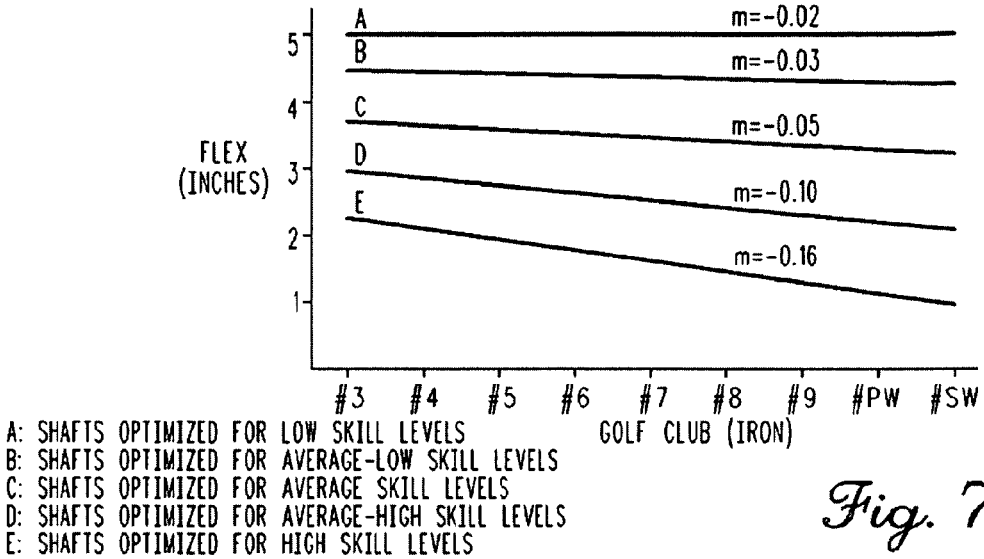
FIG. 7: Chart summarizing one of the preferred embodiments of the system and method, which illustrates five categories of shafts that are, preferably, optimized for golfers of different skill levels.

Of course, this embodiment will also employ an unlimited number of categories of shafts that are optimized for a plurality of skill levels. FIG. 7 illustrates a non-limiting example of such categories. Consistent with the foregoing, the range of flexibility exhibited by the category of shafts shown in FIG. 7 to be optimized for golfers of high skill levels, identified as "E," is greater than the category of shafts shown to be optimized for average skill levels, identified as "C." Likewise, the range of flexibility exhibited by the category of shafts shown in FIG. 7 to be optimized for golfers of average skill levels is greater than the category of shafts shown to be optimized for low skill levels, identified as "A." Still further, FIG. 7 shows two intermediate skill levels, labeled "average-low" and "average-high" skill levels, or "B" and "D," respectively. Thus, it should be clear to those skilled in the art that this embodiment encompasses an unlimited number of categories of shafts, which may be optimized for a plurality of skill levels.

In a further preferred embodiment, the system and method provide methods of optimizing sets of shafts as described above, wherein a plurality of factors related to each golfer for which any given set of shafts may be optimized are considered. Such factors may comprise, preferably, each golfer's swing speed and skill level. The plurality of factors, of course, may further include each golfer's height, age, gender, preferred shaft composition, length and diameter, and any other factors known in the art that may be considered when designing golf club shafts.

In addition to optimizing the range of flexibility exhibited by each category of shafts, the system and method, preferably, in several embodiments, provide methods of identifying the appropriate levels of flex over which the optimum range of flexibility should span. The levels of flex over which the optimum range of flexibility may span for golfers with relatively higher swing speeds will, generally, be lower than the levels of flex over which the optimum range of flexibility may span for golfers with relatively slower swing speeds. FIG. 6 illustrates this trend. For example, the levels of flex over which the set of shafts shown in FIG. 6 to be optimized for golfers with high swing speeds, identified as "E," spans from approximately 2.2 to 1.0 inches, whereas the category of shafts shown to be optimized for average swing speeds, identified as "C," spans from 3.6 to 3.2 inches. Thus, the levels of flex over which category E spans are lower than the levels of flex over which category C spans.

Similarly, the levels of flex over which the optimum range of flexibility may span for golfers of relatively higher skill are, generally, lower than the levels of flex over which the optimum range of flexibility may span for golfers of relatively lower skill. For example, the levels of flex over which the set of shafts shown in FIG. 7 to be optimized for golfers of relatively high skill, identified as "E," spans from approximately 2.2 to 1.0 inches, whereas the category of shafts shown to be optimized for golfers of average skill, identified as "C," spans from 3.6 to 3.2 inches. Thus, the levels of flex over which category E spans are lower than the levels of flex over which category C spans. It should be apparent to those skilled in the art that any of the unlimited number of categories of shafts described herein, which may be optimized for any of a plurality of golfers, may adhere this trend, or, alternatively, may not. In short, the preferred embodiments of the system and method do not require that the two or more categories of shafts described herein follow this trend without exception.

The preferred embodiments described herein may be applied to optimize any number of shafts for an entire set of clubs, or, alternatively, for less than an entire set of clubs. For example, the methods described herein may be applied to optimize the shafts that may comprise the following: (i) driver, 3-wood and 3-iron through 5-iron; (ii) 3-iron through sand wedge; or (iii) any combination of clubs that may comprise at least a part of a set of clubs.

In various preferred embodiments described herein, the range of flexibility exhibited by the sets of shafts that comprise each category, generally, increase in relation to the swing speeds and/or skill levels for which each category is optimized, wherein the range of flexibility accorded to each category increases as the corresponding swing speeds and/or skill levels for which such categories of shafts are optimized increase. It should be apparent to those skilled in the art that the foregoing trend may be applied to any range of shaft flexibility. In FIGS. 1-7, for example, the general range of flexibility within which the several categories of shafts exist is limited to 0-5 inches. This general range is provided only to illustrate the preferred embodiments of the system and method. The general range of flexibility within which two or more categories of shafts exist may span less than 5 inches, or, alternatively, more than 5 inches. Furthermore, the relative flexibility of each shaft that comprises each category of shafts can be measured using any method and metric known in the art.

Still further, the system and method provide sets of golf clubs that include a plurality of shafts that exhibit a range of flexibility, which are optimized in accordance with the methods and embodiments described herein. For example, the system and method provide golf club shafts that are optimized for (i) any of a plurality of swing speeds, (ii) golfers exhibiting any of a plurality of skill levels, or (iii) golfers exhibiting any specific combination of skill and swing speed.

Figure 13:
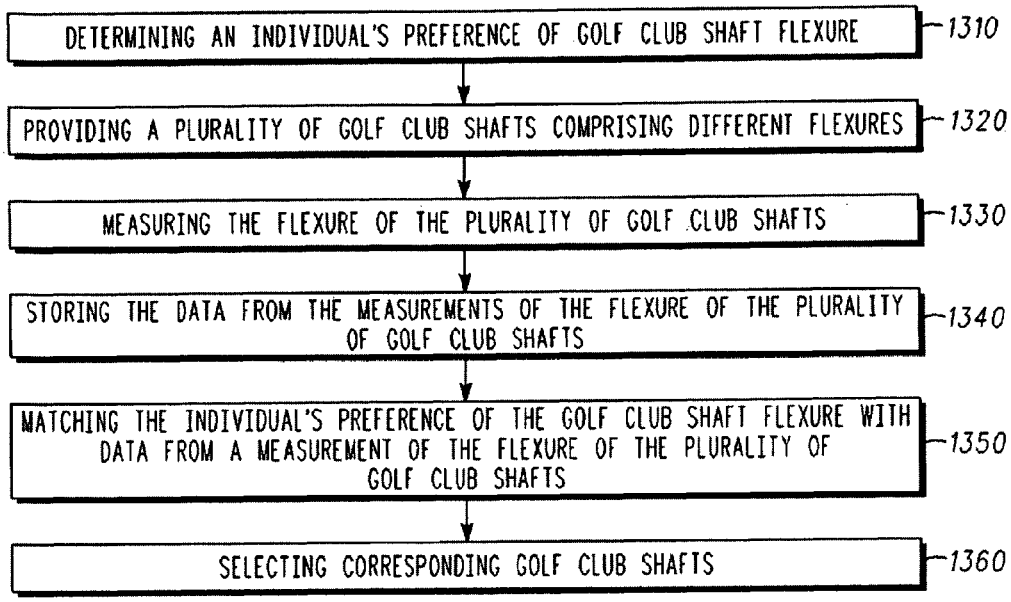
FIGS. 13-18: Depict flow diagrams representative of a manner to provide a flex-matched set of golf clubs for an individual according to an embodiment.

In an exemplary embodiment shown in FIG. 13, a method 1300 to provide a matched set of golf clubs comprises: determining an individual's preference of golf club shaft flexure (block 1310), providing a plurality of golf club shafts comprising different flexures (block 1320), matching the individual's preference of the golf club shaft flexure with data from a measurement of the flexure of the plurality of golf club shafts (block 1350), and selecting corresponding golf club shafts (block 1360). The process of providing a plurality of golf club shafts comprising different flexures (block 1320) can comprise providing shafts comprising lengths that correspond to specific golf club heads.

Figure 8:
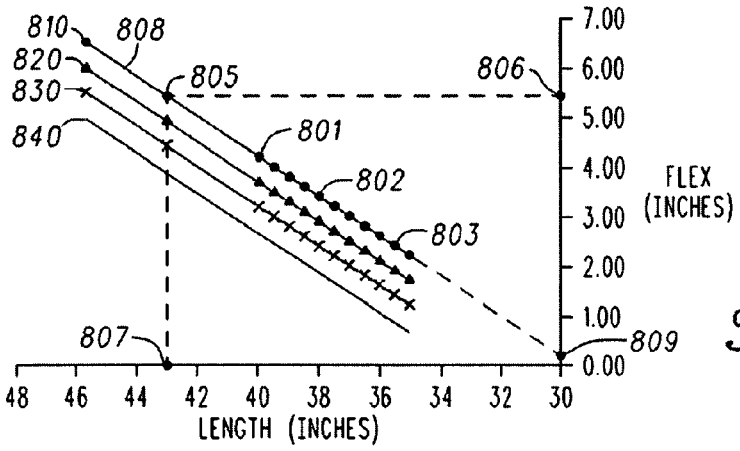
FIG. 8: Chart illustrating a linear relationship of four sets of flex-matched golf club shafts when plotting a shaft length versus a flex displacement under a constant load.

For example, and with reference to chart 800 of FIG. 8, one embodiment of providing a plurality of golf club shafts comprising different flexures (block 1320 in FIG. 13) is illustrated by the flex matching chart showing a linear relationship between four sets of flex matched golf clubs. Line 810 shows one set of flex matched shafts; line 820 shows a second set of flex matched shafts; line 830 shows a third set of flex matched shafts; and line 840 shows a fourth set of flex matched shafts. Moreover, each line shows how the golf club shafts associate with each line. For example, shafts 801, 802, and 803 correspond to a golf club shaft set represented by line 810. FIG. 8 also depicts the various golf club shaft sets having the same slope. Other embodiments can comprise flex matched shafts comprising a linear relationship, but two or more different slopes, as illustrated in the previous figures.

Figure 9:
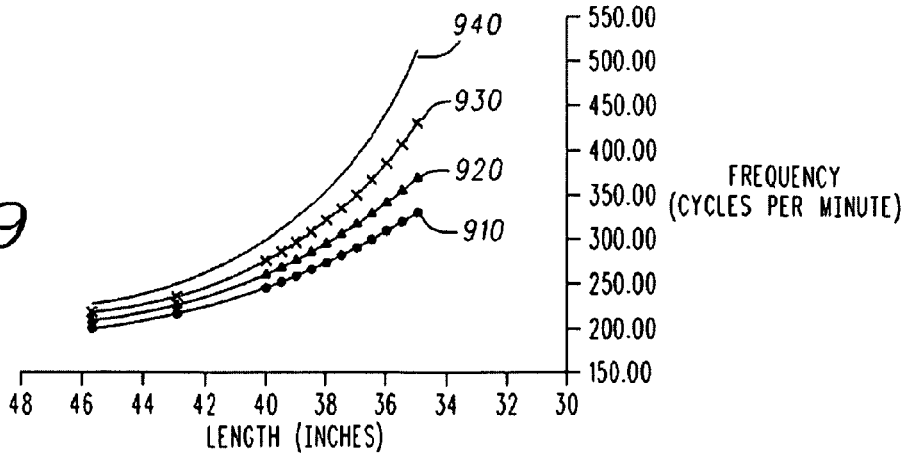
FIG. 9: Chart illustrating a non-linear relationship of the four sets of flex-matched golf club shafts of FIG. 8 when plotting a shaft length versus a frequency of a shaft for each shaft in a golf club set.

The golf club shafts of FIG. 8 are plotted as flex of the shaft or shaft displacement under a fixed weight or load versus length of the shaft. In one embodiment, the different lengths of golf club shafts can be representative of the different golf clubs described with reference to the previous figures. As can be seen with reference to chart 900 of FIG. 9, the linear relationship of the sets of golf club shafts in FIG. 8 changes when those same sets of golf club shafts are plotted by oscillation frequency of the shaft versus length of the shaft. In particular, the frequency to length relationship comprises a line having an order greater than one and can be represented by a fourth order quadratic equation, among other non-linear equations. The golf club shafts along lines 910, 920, 930, and 940 in FIG. 9 correspond to or are the same golf club shafts along lines 810, 820, 830, and 840, respectively, in FIG. 8.

Figure 12:
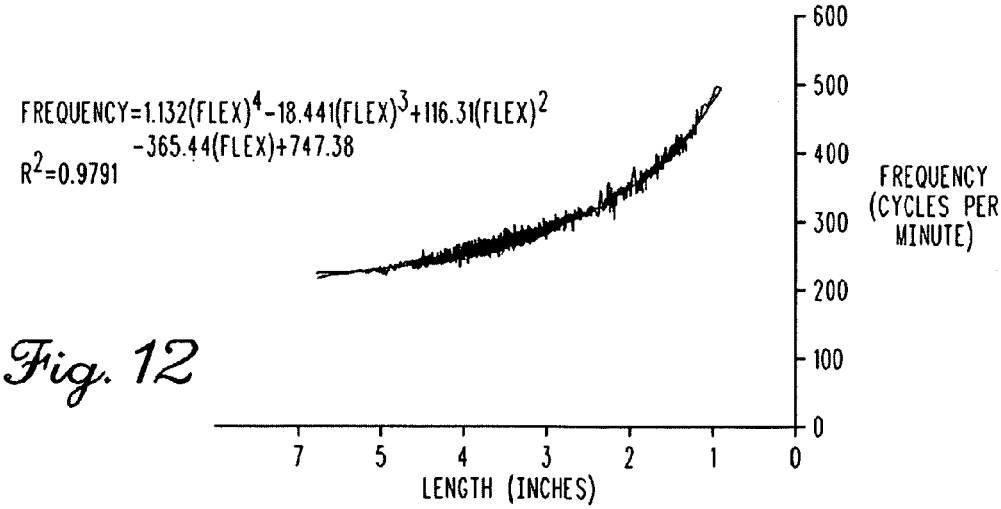
FIG. 12: Chart illustrating the non-linear relationship between shaft flexibility and shaft frequency.

Also, FIG. 12 shows an exemplary non-linear relationship between flex and frequency. In particular, FIG. 12 shows the relationship represented by a fourth order quadratic equation, but in other embodiments, the relationship can be represented by other non-linear equations.

Among the various embodiments described herein, the term "flex" or "flexure" is used to described a characteristic of the various sets of golf club shafts, and/or their relationships to one another. Flex or flexure as recited herein refers to the degree of flex (or position displacement) a golf club shaft exhibits when a known force is exerted upon a portion of the golf club shaft. For example, the various golf club shafts can have a fixed or predetermined mass attached to one end of a shaft while the shaft is clamped in a horizontal position. The displacement (flex) of the shaft end due to the attached mass can then be measured and recorded as data. Other exemplary embodiments can comprise the mass attached at other portions of a shaft as well. The shaft can also be clamped in a vertical position, and a predetermined or known force can be applied in a "push" or "pull" manner, and the displacement (flex) of the shaft can be similarly measured and recorded as data.

Moreover, any other embodiments that allow the displacement (flex) of a shaft to be measured as a result of an applied predetermined or known force, is contemplated by this disclosure. For example, a tip flex method can be used to measure the flex at the tip of the shaft where the tip end of the shaft is clamped while measuring a deflection of the opposite butt end of the shaft. Additionally, a butt flex method can be used to measure the flex at the butt end of the shaft where the butt end of the shaft is clamped while measuring a deflection of the opposite tip end of the shaft. Other variations can include, among other things, clamping the shaft at a midpoint and measuring the deflection at one or both of the tip and butt ends.

This disclosure also discusses the oscillation frequency characteristics of a shaft, and such discussions are generally directed towards comparing such oscillation frequency characteristic to the flex characteristic. The oscillation frequency characteristic as discussed herein, generally describes the oscillation a golf club shaft exhibits when a known or predetermined force is applied to a portion of a golf club shaft, and the force is released thereby allowing the shaft to oscillate. The number of cycles per minute ("CPM") are then measured and plotted, such as the plot illustrated in FIG. 9. In some exemplary embodiments, to measure oscillation frequency, instead of applying a known or predetermined force, some oscillations can be initiated by displacing a portion of the shaft a fixed displacement, for example by displacing a shaft end 8 centimeters and then releasing. In any event, this disclosure contemplates matching a set of golf club shafts by matching a linear flex-matched set of golf club shafts, as opposed to a linear frequency-matched set of golf club shafts. As seen from FIGS. 8, 9, and 12, a linearly flex-matched set of golf club shafts will produce a non-linearly frequency-matched set of golf club shafts.

Figure 14:
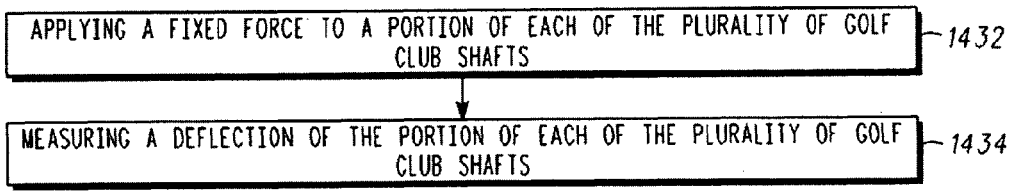
Figure 15:
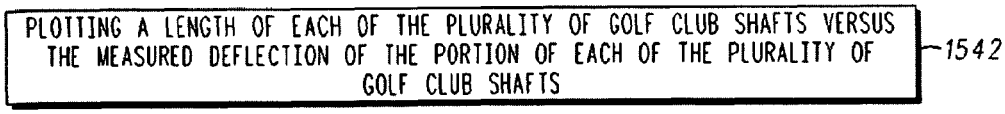

Continuing with the exemplary embodiment of FIG. 13, method 1300 can further comprise: measuring the flexure of the plurality of golf club shafts (block 1330), and storing data from the flexure measurement of the plurality of golf club shafts (block 1340). As just described, FIG. 8 illustrates such data stored from the flexure measurement. The process of measuring the flexure of the plurality of golf club shafts (block 1330 in FIG. 13) can comprise applying a fixed force to a portion of each of the plurality of golf club shafts (block 1432 in FIG. 14) and measuring a deflection of the portion of each of the plurality of golf club shafts (block 1434 in FIG. 14), as described above. The process of storing the data from the measurement of flexure of the plurality of golf club shafts (block 1340 in FIG. 13) can comprise plotting the length of each of the plurality of golf club shafts versus the measured deflection of the portion of each of the plurality of golf club shafts (block 1542 in FIG. 15), again, as shown in FIG. 8.

Figure 16:
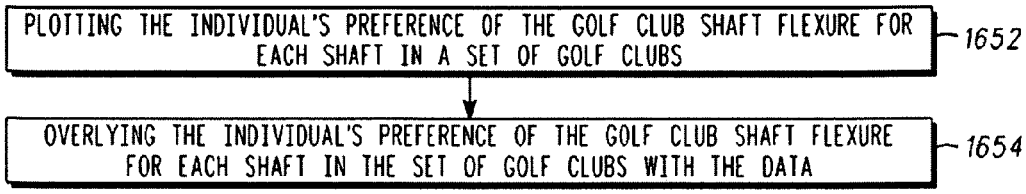

The process of matching the individual's preferences of the golf club shaft flexure with the data from the measurement of the flexure of the plurality of golf club shafts (block 1350 in FIG. 13) can comprise plotting the individual's preference of the golf club shaft flexure for each shaft in a set of golf clubs (block 1652 in FIG. 16), and overlaying the individual's preference of the golf club shaft flexure for each shaft in the set of golf clubs with the data (block 1654 in FIG. 16). For example, with reference to chart 1100 of FIG. 11, lines 1170, 1172, and 1174 comprise three different individuals' preferences for flexure. Line 1170 represents flexure preferences for one individual; line 1172 represents flexure preferences for a second individual; and line 1174 represents flexure preferences for a third individual. It is clear from this chart that, as expected, different individuals have different preferences. Thus, to select the proper set of golf club shafts for an individual, the individual's preferences for flexure can be overlayed with the various sets of measured golf club shafts. For example, the preference of line 1170 in FIG. 11 can be overlayed with the golf club shaft sets depicted by one or more of lines 810, 820, 830, and 840 in FIG. 8. The line in FIG. 8 that corresponds in a substantially similar fashion (i.e., having substantially the same slope and y-intercept) to the line for the individual's preferences for flexure represents the set of golf club shafts that is properly matched to the individual. In a different embodiment, a set of shafts can be specifically manufactured to match the individual's preferences for shaft flex versus shaft length.

Figure 10:
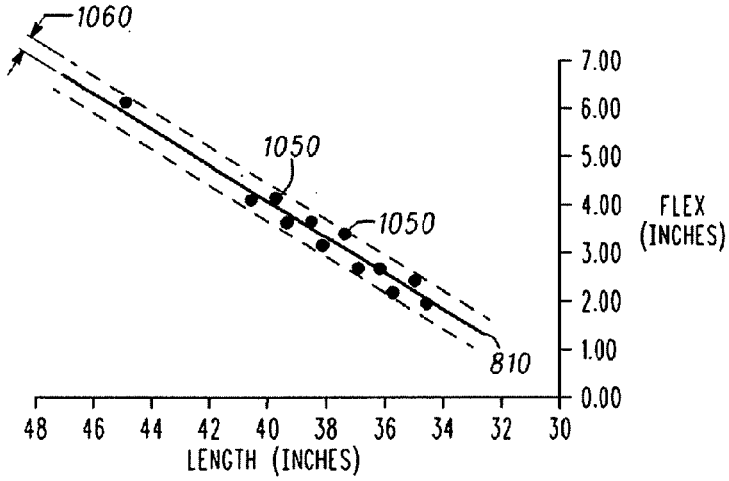
FIG. 10: Chart illustrating how the measurement for each golf club shaft lies within a predetermined variation of the line that represents the linear relationship of the set of golf club shafts.
Figure 17:
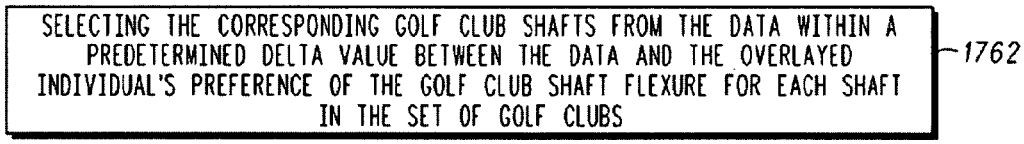

The process of selecting corresponding golf club shafts (block 1360 in FIG. 13) can be based on the matching process of block 1350 (as described above with reference to FIG. 13) and can also comprise selecting the corresponding golf club shaft from the data within a predetermined delta value between the data and the overlayed individual's preference of the golf club shaft flexure for each shaft in the set of golf clubs (block 1762 in FIG. 17). With respect to data stored within a predetermined delta value, reference is made to chart 1000 of FIG. 10. Line 810 in FIG. 10 shows a linear flex matched set of golf club shafts, wherein exemplary shafts are shown by points 1050 on the graph. Furthermore, it can be seen how the various shafts 1050 lie with a predetermined delta value 1060 of line 810 due to manufacturing variations while still meeting or approximating the linear flex requirement of line 810. As an example, predetermined delta value 1060 can be one or two standard deviations from line 810, or another predetermined band.

Figure 11:
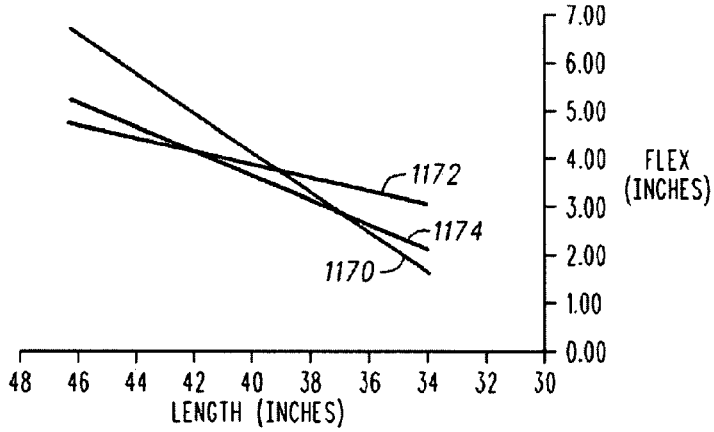
FIG. 11: Chart illustrating the flex matching profile for different individuals.
Figure 18:
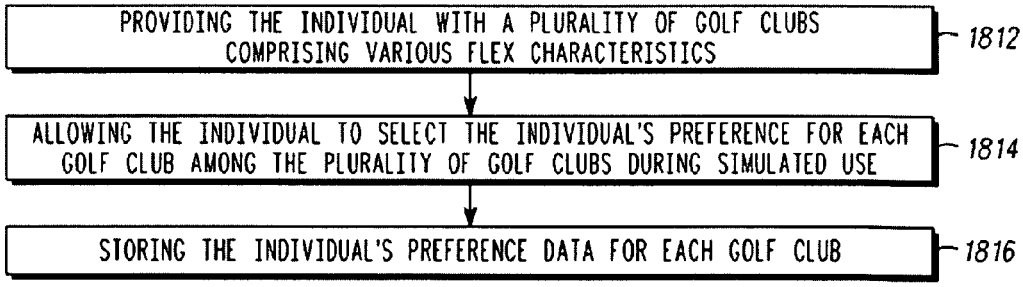

Continuing with the exemplary embodiment, the process of determining the individual's preference of golf club shaft flexure (block 1310 in FIG. 13) can comprise: providing the individual with the plurality of golf clubs comprising various flex characteristics (block 1812 in FIG. 18), allowing the individual to select his preference for each golf club among the plurality of golf clubs during simulated use (block 1814 in FIG. 18), and storing the individual's preference data for each golf club (block 1816 in FIG. 18), wherein the individual's preferences that are stored are again shown in FIG. 11.

Among various exemplary embodiments, the process of providing the individual with the plurality of golf clubs comprising various flex characteristics (block 1812 in FIG. 18) can comprise providing the individual with a plurality of drivers, woods, hybrids, and irons, and can also comprise providing multiple (e.g., four) types of golf club shaft stiffnesses.

Figure 19:
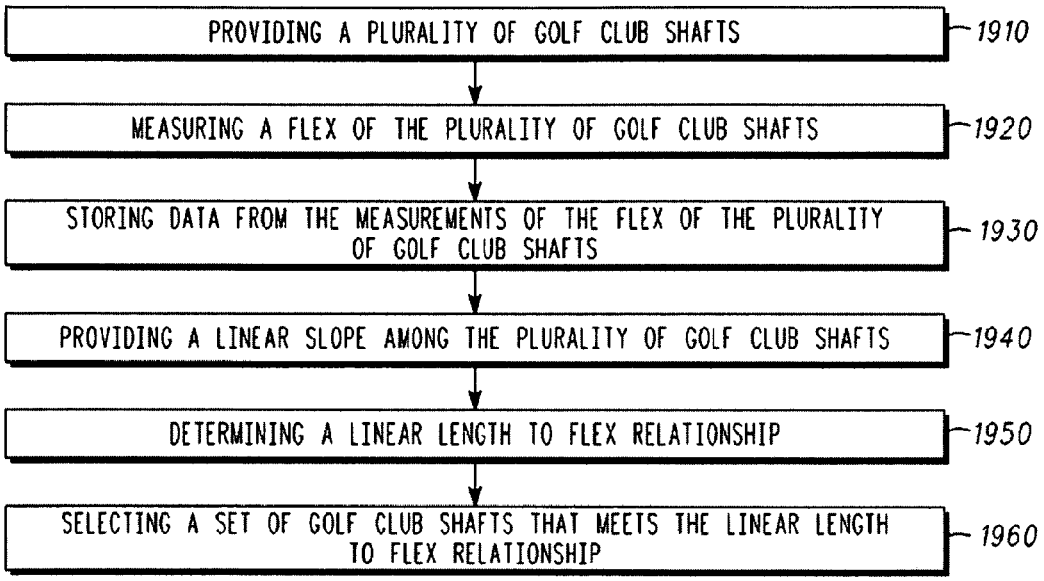
FIG. 19: Depicts a flow diagram representative of a manner to provide a flex-matched set of golf clubs for an individual according to another embodiment.

In another exemplary embodiment shown in FIG. 19, method 1900 to select a matched set of golf club shafts based upon normalized flex comprises: providing a plurality of golf club shafts (block 1910); determining a linear length to flex relationship among the plurality of golf club shafts (block 1950); and selecting a set of golf club shafts that meets or approximates the linear length to flex relationship (block 1960). The method can further comprise: measuring a flex of the plurality of golf club shafts (block 1920); storing data from the measurement of the flex of the plurality of golf club shafts (block 1930); and providing a linear slope among the plurality of golf club shafts (block 1940). Again, as shown in FIG. 8, a plurality of golf club shafts is shown with the measured linear length to flex relationship determined among them and stored as data points.

In an exemplary embodiment, a matched set of golf clubs can comprise a plurality of golf club shafts determined by: a flexure measurement of a plurality of golf club shafts; data stored from the flexure measurement of the plurality of golf club shafts; and a match between the data and an individual's preference for golf club shaft flex. The matched set of golf clubs can also comprise a plurality of golf club heads coupled to a set of the plurality of golf club shafts.

In another exemplary embodiment, a matched set of golf clubs comprises: a first golf club comprising a first shaft comprising a first length and a first flexure, a second golf club comprising a second shaft comprising a second length and a second flexure, and a third golf club comprising a third shaft comprising a third length and a third flexure. The first flexure, the second flexure, and the third flexure can correspond to a linear flexure-to-shaft length relationship and/or a linear flexure-to-club relationship. For example, as shown in FIG. 8, the first shaft can corresponds to shaft 801, the second shaft can correspond to shaft 802, and the third shaft can correspond to shaft 803. Line 810 illustrates the linear relationship between shafts 801, 802, and 803.

The matched set of golf club shafts can also comprise the linear flexure relationship that substantially satisfies a shaft equation $y=mx+b$ for a line, wherein, y comprises a flexure value, for example y-value 806, x comprises a shaft length value, for example x-value 807, m comprises a slope of the relationship between the flexure value and the length value, for example slope 808, and b comprises a y-intercept, for example y-intercept value 809. In this exemplary embodiment, the matched set of golf clubs comprises the shaft equation to comprise a substantially similar shaft slope and substantially similar shaft y-intercept to an individual's preferred shaft equation, slope, and y-intercept (i.e., by matching an individual's preference line, such as a line from FIG. 11 with a corresponding line in FIG. 8).

Similar to other exemplary embodiments, the matched set of golf clubs can comprise the first shaft, the second shaft, and the third shaft to correspond to specific golf club heads. Furthermore, the matched set of golf clubs can comprise the first shaft, the second shaft, and the third shaft to comprise shafts for a plurality of drivers, woods, hybrids, or irons.

Of course, the golf club shafts described and claimed herein can be made of steel, graphite, steel and graphite, or any other composition by itself or in combination with others known in the art to be useful in producing and/or designing golf club shafts. Furthermore, the shafts described and claimed herein can be manufactured and/or mass produced using any method known in the art today or discovered hereafter.

The many aspects and benefits of the system and method are apparent from the detailed description, and thus, it is intended for the following claims to cover all such aspects and benefits of the system and method which fall within the scope and spirit of the system and method. In addition, because numerous modifications and variations will be obvious and readily occur to those skilled in the art, the claims should not be construed to limit the system and method to the exact construction and operation illustrated and described herein.

For example, although specific golf club names are used, the disclosure is not limited to such golf club names. In particular, although a 3-iron is shown in the figures and described herein, it is understood that the term "3-iron" is not limited to only a golf club called a 3-iron. Instead, the term "3-iron" can include one or more equivalent clubs such as, for example, a 21-degree hybrid club. Similarly, the disclosed "4-iron" can include one or more equivalent clubs such as, for example, a 24-degree hybrid, and the disclosed "sand wedge" can include one or more equivalent clubs such as, for example, a 60-degree wedge. Other equivalents are also contemplated herein.

Furthermore, although not expressly identified above, other golf clubs can be used with this system and method. For example, a lob wedge can be added to the far right-hand portion of each of the graphs in FIGS. 1-11, where the lob wedge has a shorter golf club shaft length than the sand wedge. Accordingly, all suitable modifications and equivalents should be understood to fall within the scope of the system and method as claimed herein.

What is claimed is:

1. A method comprising:

categorizing a plurality of golf club shafts into a plurality of golf club shaft sets based on a flexibility of the plurality of golf club shafts;

determining a golfing level of an individual to whom a proposed golf club shaft set will be matched; and selecting the proposed golf club shaft set from the plurality of golf club shaft sets of different golfing levels to fit the golfing level of the individual;

wherein: categorizing the plurality of golf club shafts comprises:

measuring the flexibility of the golf club shafts using a flexibility measuring mechanism configured to apply a predetermined force to the plurality of golf club shafts, wherein the plurality of golf club shafts are decoupled from any golf club heads when the flexibility is measured;

the plurality of golf club shaft sets comprises:

a first golf club shaft set with a first shaft flexibility range and configured for a high golfing level;

a second golf club shaft set with a second shaft flexibility range and configured for a medium golfing level; and a third golf club shaft set with a third shaft flexibility range and configured for a low golfing level;

the first shaft flexibility range is greater than the second shaft flexibility range;

the second shaft flexibility range is greater than the third shaft flexibility range;

the proposed golf club shaft set comprises proposed golf club shafts and a proposed shaft flexibility variance; and the proposed shaft flexibility variance of the proposed golf club shaft set is irregular among the proposed golf club shafts within the proposed golf club shaft set.

2. The method of claim 1, wherein:

an amount of flex for each golf club shaft within the first golf club shaft set is less than an amount of flex for each golf club shaft within the third golf club shaft set.

3. The method of claim 1, wherein:

the proposed shaft flexibility variance is linear between three or more of the proposed golf club shafts of the proposed golf club shaft set.

4. The method of claim 3, wherein:

the three or more of the proposed golf club shafts of the proposed golf club shaft set comprise a non-linear relationship between golf club shaft length and golf club shaft oscillation frequency.

5. The method of claim 1, wherein:

the first golf club shaft set comprises:

a first subset of shafts comprising a first subset shaft flexibility variance therebetween; and a second subset of shafts comprising a second subset shaft flexibility variance therebetween;

the first subset shaft flexibility variance is different than the second subset shaft flexibility variance;

the second golf club shaft set comprises:

a third subset of shafts comprising a third subset shaft flexibility variance therebetween; and a fourth subset of shafts comprising a fourth subset shaft flexibility variance therebetween;

and the third subset shaft flexibility variance is different than the fourth subset shaft flexibility variance.

6. The method of claim 1, wherein:

the high golfing level is correlated to at least one of:

a high swing speed; or a high skill level;

and the low golfing level correlated to at least one of:

a low swing speed; or a low skill level.

7. The method of claim 1, wherein:

the plurality of golf club shaft sets comprises:

a first shaft flexibility range difference comprising a difference between the first and second shaft flexibility ranges; and a second shaft flexibility range difference comprising a difference between the second and third shaft flexibility ranges;

and the first and second shaft flexibility range differences are different from each other.

8. The method of claim 1, wherein:

the first shaft flexibility range is determined from a difference between:

a shaft flexibility of a shortest golf club shaft of the first golf club shaft set; and a shaft flexibility of a longest golf club shaft of the first golf club shaft set;

the second shaft flexibility range is determined from a difference between:

a shaft flexibility of a shortest golf club shaft of the second golf club shaft set; and a shaft flexibility of a longest golf club shaft of the second golf club shaft set;

and the third shaft flexibility range is determined from a difference between:

a shaft flexibility of a shortest golf club shaft of the third golf club shaft set; and a shaft flexibility of a longest golf club shaft of the third golf club shaft set.

* * * * *